US007895697B2

(12) United States Patent
Cassar

(10) Patent No.: US 7,895,697 B2
(45) Date of Patent: Mar. 1, 2011

(54) QUICK DISCONNECT SWIVEL CONNECTOR FOR MULTIPLE CLEANING DEVICES

(76) Inventor: Simon Ralph Cassar, Watsonville, CA (US)

( * ) Notice: Subject to any disclaimer, the term of this patent is extended or adjusted under 35 U.S.C. 154(b) by 0 days.

(21) Appl. No.: 10/859,714

(22) Filed: Jun. 3, 2004

(65) Prior Publication Data

US 2004/0244131 A1 Dec. 9, 2004

(51) Int. Cl.
*A47L 13/20* (2006.01)

(52) U.S. Cl. ..... 15/144.1; 15/228; 15/229.1; 15/229.6; 15/172

(58) Field of Classification Search ..... 15/144.1, 15/144.2, 228, 229.1–229.9, 172, 147.1
See application file for complete search history.

(56) References Cited

U.S. PATENT DOCUMENTS 1,896,843 A * 2/1933 Hall, Jr ..... 15/144.1
2,286,655 A * 6/1942 Supnick ..... 403/100
2,704,853 A * 3/1955 Gantz ..... 15/168
3,006,668 A * 10/1961 Stewart ..... 403/68
3,016,556 A * 1/1962 Greenleaf ..... 15/229.8
3,045,271 A * 7/1962 Cinotti ..... 15/235.8
3,051,976 A * 9/1962 Dubois et al. ..... 15/144.2
3,506,996 A * 4/1970 Brennan ..... 15/144.1
5,207,754 A * 5/1993 Harrah ..... 15/147.1
5,243,729 A * 9/1993 Tomm ..... 15/147.1
5,333,345 A * 8/1994 O'Donnell ..... 15/159.1
5,901,402 A * 5/1999 Williams ..... 15/144.1
6,061,864 A * 5/2000 Ensson ..... 15/147.1
6,237,182 B1 * 5/2001 Cassar ..... 15/144.1
6,279,189 B1 * 8/2001 Cassar ..... 15/144.1

* cited by examiner

*Primary Examiner*—Shay L Karls

(57) ABSTRACT

An adjoined flexible two-piece swivel joint type floor cleaning attachment in which either upper or lower and/or both sections are made from a unitary flexible elastomer material allowing for a unitary quick release clamp mechanism that adjoins to a cleaning head apparatuses. The combination of the quick release unitary flexible clamp mechanism adjoined to a jam/stop swivel mechanism allows for small cleaning devices, such as scrub brushes, wall washers, abrasive pad holders, etc. to be easily engaged and disengaged allowing the cleaning device to also be used as a hand held device. Furthermore, swivel type floor cleaning devices will no longer need their own swivel type connector affixed onto the cleaning head thus making the cleaning products more cost efficient.

14 Claims, 3 Drawing Sheets

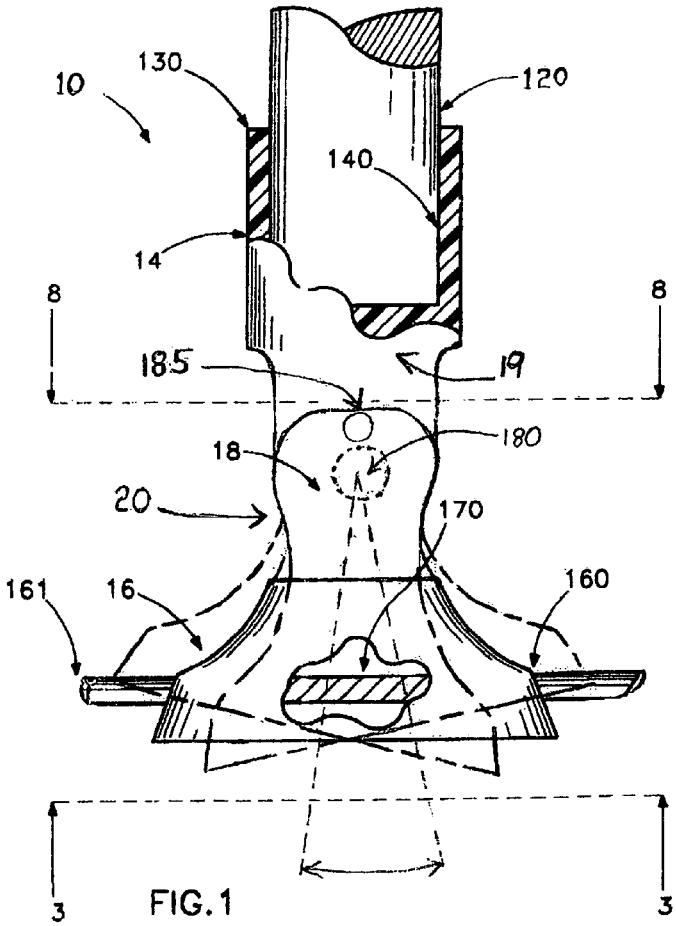
FIG. 1
FIG. 2
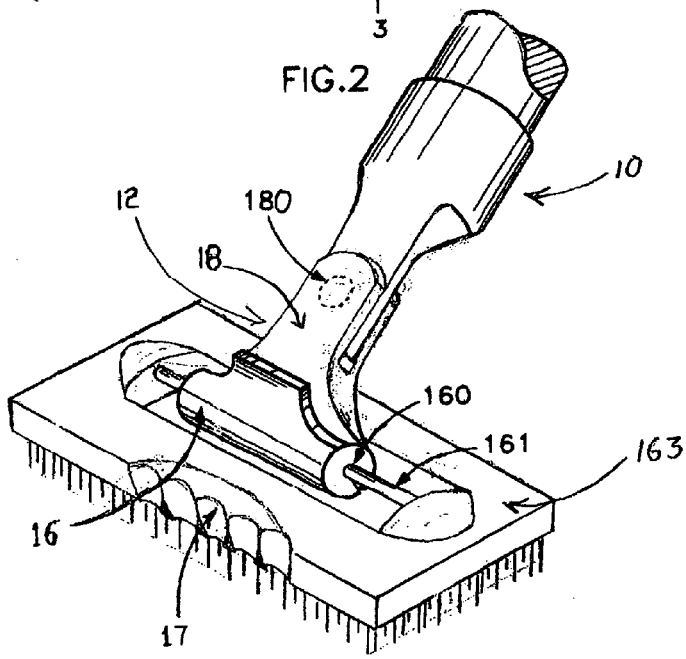
FIG. 3
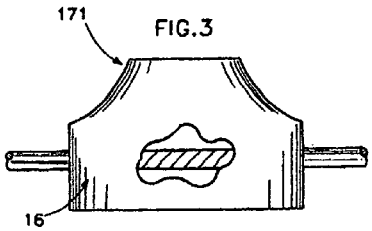

180
178

180
177

14
10
177
19
71
172
180
173
152
170
160
150

14
18
180
187
18
19

177
185
180
18
170

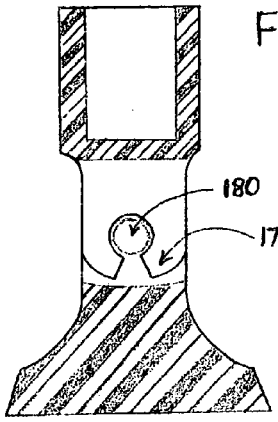
FIG. 10
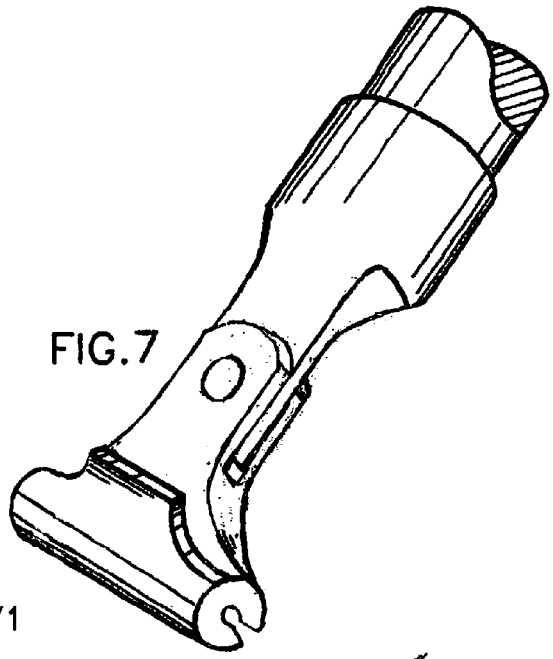
FIG. 7
FIG. 8
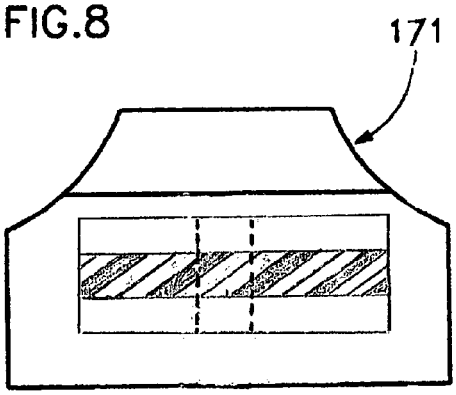
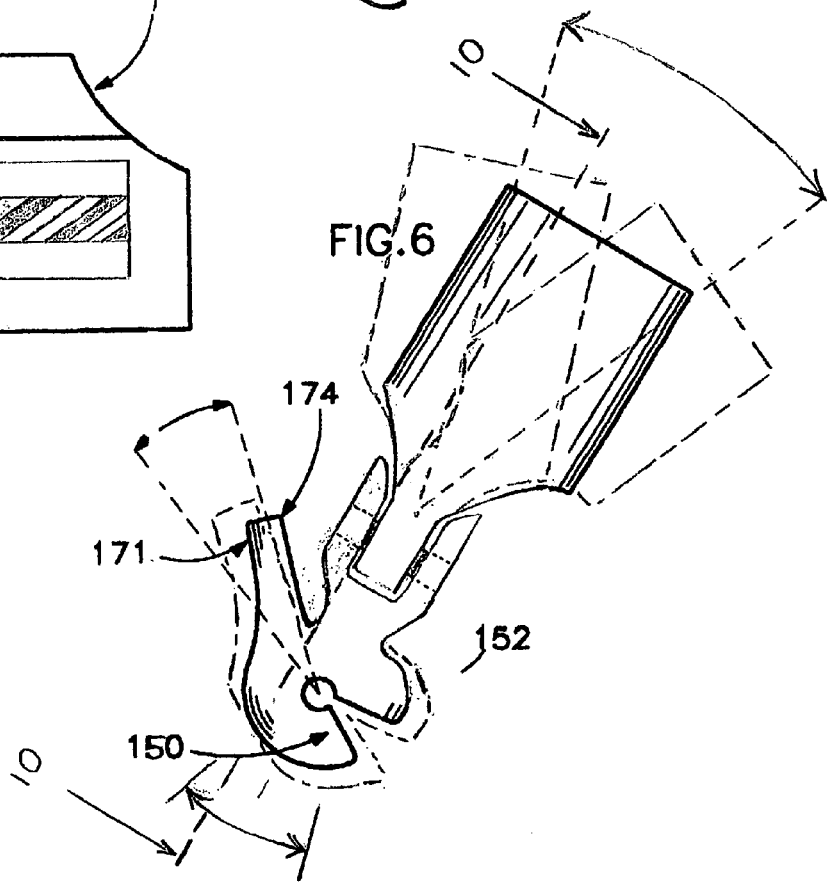
FIG. 6

QUICK DISCONNECT SWIVEL CONNECTOR FOR MULTIPLE CLEANING DEVICES

BACKGROUND OF THE INVENTION

1. Background of the Invention

The present invention relates to a scrubbing, dust mopping, or a sweeping apparatus and in particular to scrub brushes or applications where material is being removed by an apparatus. The present invention relates to a swivel joint two piece unitary flexible molded elastomer attachment that allows multiple cleaning apparatuses to be attached and detached for cleaning purposes. The new innovation allows for easy engagement and disengagement of the swivel mechanism to the cleaning head apparatus thus eliminating costly swivel joints that are adjoined to prior art swivel joint type cleaning apparatuses. In addition, the swivel type cleaning head apparatuses can be used as a hand held cleaning apparatus when not engaged with the swivel type joint quick release mechanism. In addition, using an elastomer material for the jaw type connector that encompasses the swivel axis allows for the jaws to be preloaded thus the swivel does not become loose.

2. Description of Prior Art

The standard swivel type floor cleaning apparatus has two primary components. The first component is the floor cleaning head such as a dust mops, wall washer, grout cleaner, scrub brush, abrasive pad holder. All these floor-cleaning apparatuses have an adjoined embodied swivel type connector that is permanently attached to the cleaning apparatus making them very costly. The second primary component of floor cleaning apparatuses is the handle which is usually a cylindrical pole that is inserted into the swivel joint handle connector. The floor handle connector is only removable by unthreading the lock nut or twisting the handle out of the handle connector leaving the swivel joint mechanism attached to the cleaning apparatus. The combination of the unitary elastomer quick disconnect and rotating swivel type mechanism permits all floor cleaning apparatuses to be pushed and pulled by exertion of a force on the handle and flex when coming in contact with obstacles. Prior art has also addressed the issue of loose swivels as in U.S. Pat. No. 4,763,377

One significant problem with swivel type floor cleaning apparatuses is the swivel type apparatus eventually breaks around the swivel type axis and/or upper and lower support members supporting the axis when either hitting stationary objects or abuse. Also, when jam pin is inserted into the swivel joint to allow only one position to be retained, the leverage caused by the jam/stop causes swivel type attachments that are not made from flexible material to easily break. Also swivel joints that are used to adjoin a cleaning apparatuses like scrub brushes, wall cleaning, abrasive pad holders, flat wet mops and small dust mops are attached to the cleaning apparatus making the cleaning apparatus costly to manufacture. Such is the case in prior art U.S. Pat. No. 4,763,377. Also, the cleaning apparatus can only be used for floor cleaning due to the large swivel joint adjoined to the cleaning apparatus. Prior art such as "Flexible Elastomer Floor Dust Mop Attachment", U.S. Pat. No. 6,237,182 does allow for easy disengagement and does preload the axis due to the elastomer material wrapping around the axis, but due to its flexible joint between the clamp and the handle connector, verses a swivel type joint, the flexible member does not allow for small cleaning device such as scrub brushes and other small cleaning apparatuses to lay flat on the ground during the cleaning operation and instead part of the scrub brush is lifted up when the flexible joint is pivoted. Simply put, the flexible joint acts as a spring action causing the floor cleaning apparatus to lift up on the opposing side of the pivoting action. On large dust mops this is not so evident, but on smaller cleaning apparatuses such as a scrub brush, wall washers and small dust mop frames this is unfortunately extremely apparent. Also, the flexible one piece joint cannot allow for the swivel movement to become fixed and not flex when cleaning areas that do not require the cleaning apparatus to swivel but instead to remain stationary. However, the present invention allows for the swivel movement to be jam/stop by the use of a jam pin thus stopping the swivel movement. Other disengagement type swivel joints like Large dust mop frames do have disconnecting swivel joints like U.S. Pat. No. 5,901,402 but due to the large size of the connector, multiple parts causing looseness when attached to a small cleaning device they are not functional. Also, prior art U.S. Pat. No. 4,763,377 prevents loose swivels but is not as cost effective as the present invention due to the swivel joint being attached directly to the cleaning apparatus so when the brush is worn both the brush and swivel joint is discarded thus making the product more costly that a reusable swivel joint that can be used on other cleaning apparatuses.

Therefore, a significant need exists to improve upon the previous patents that allows for an elastomeric flexible swivel connector that when abused or placed in a fixed position flexes thus eliminating breakage and negotiates around obstacles that would of otherwise break or damaged the fixed position or swivel type handle connector. Also, allows for a more cost effective non-loosening swivel type floor connector that can be easily detached from multiple cleaning devices thus allowing the cleaning apparatus to also be used for hand operations thus reducing cost, space and increasing durability.

SUMMARY OF THE PRESENT INVENTION

The present invention is a swivel type mechanism that is affixed at the location between a handle and head of the floor cleaning apparatus to provide a flexible member at the junction where the floor cleaning handle apparatus is attached to the floor cleaning apparatus head. Through use of the swivel type connector member, when the floor cleaning apparatus head comes in contact with a stationary object the floor cleaning apparatus will flex beyond 90 degrees deflection around the longitudinal axis in relation to the floor cleaning apparatus.

It is therefore an object of the present invention to provide an elastomer disengaging apparatus by which a flexible floor cleaning apparatus can swivel without being damaged when abused or loosening and also be used for hand held operations that can be economically manufactured.

Further novel features and other objects of the present invention will become apparent from the following detailed description, discussion and the appended claim, taken in conjunction with the drawings.

BRIEF DESCRIPTION OF THE DRAWINGS

Referring particularly to the drawings for the purpose of illustration only and not limitation, there is illustrated:

FIG. 1. Is a perspective view of the preferred embodiment of the present invention floor cleaning handle apparatus attached to the floor scrub brush.

FIG. 2 is a perspective view of the preferred embodiment of the present invention floor-cleaning handle apparatus attached to the floor scrub brush.

FIG. 3. Is a cross-sectional view looking up taken along line 3-3 of FIG. 1.

FIG. 6. Is a side elevational view of the preferred embodiment of the present invention floor cleaning handle apparatus illustrating the movement of the elastomer hinge allowing an opening for the floor cleaning apparatus support frame to be attached.

FIG. 7. Is an isometric view of the floor cleaning handle apparatus in its entirety.

FIG. 8 Is a cross-sectional view looking down taken along line 8-8 of FIG. 1.

FIG. 10. Is a cross-sectional view looking down taken along line 10-10 of FIG. 6.

DETAILED DESCRIPTION OF THE PREFERRED EMBODIMENT

Figures 4, 5, 9, 11, 12:
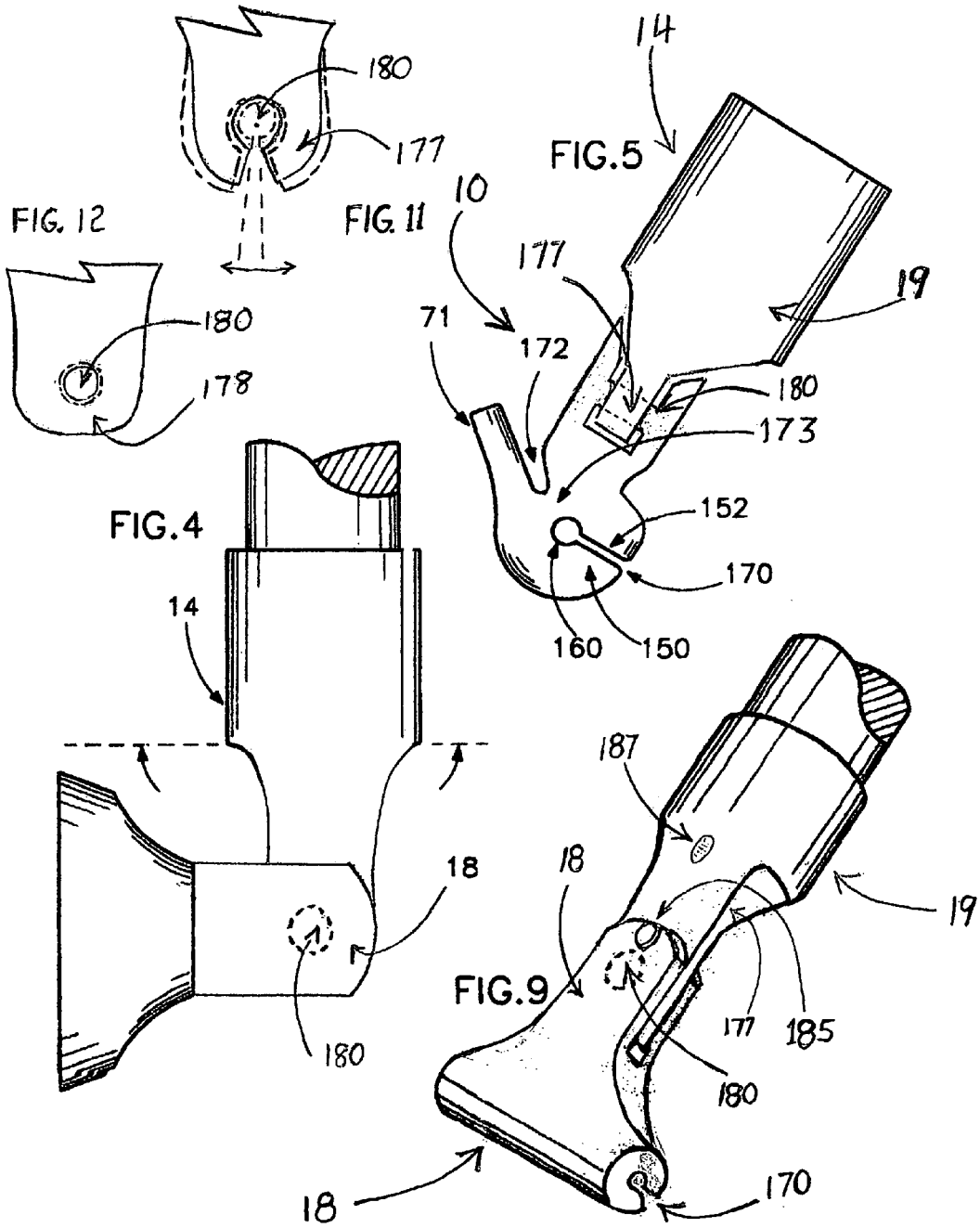
FIG. 4. Is a front elevational view of the preferred embodiment of the present invention floor cleaning handle apparatus illustrating the movement of the attachment when in contact with a stationary object.
FIG. 5. Is a side elevational view of the preferred embodiment of the present invention floor cleaning handle apparatus.
FIG. 9. Is an isometric view of the floor cleaning handle alternate attachment in its entirety.
FIG. 11. Is a perspective view of the jaw clamp preloaded onto the rotating shaft axis.
FIG. 12. Is a perspective view of the jaw clamp alternative preloaded onto the rotating shaft axis.

Although specific embodiments of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope and contemplation of the invention as further defined in the appended claims.

In the preferred embodiment, the insert member 10 in FIG. 1 is made of any flexible substance with memory such as rubber, urethane, nylon, plastic, titanium, polyvinyl. It is also within the spirit and scope of the present invention for the attachment to be made of flexible but strong plastic such as mylar, polypropylene or any other flexible material exhibiting the required characteristics.

Referring to FIG. 1, there is shown at 10 the present invention swivel connector or multiple cleaning apparatuses. The apparatus is made from an elastomeric material comprised of two pieces upper support member 19 and lower support member 18 joined together at the rotating axis 180. Lower support member 18 is made from an elastomeric flexible material with sufficient memory to retain support bar 16. Either and/or both 18 or 19 is made from a flexible elastomeric material thus allowing the clamp mechanism 16 and support frame 161 to rotate laterally around the flexible mid section axis 20 when the support pin 185 is engaged or when not engaged to flex beyond full 180 degrees deflection thus eliminating breakage that could occur to handle, connector or floor cleaning devices. Phantom lines illustrating the flexing movement can be seen when pin 185 is engaged.

It should be noted that the rotating axis is not limited to the type of axis used. For example the rotating axis member 180 could be an integrally unitary molded shaft that makes up the lower support member 18 or could be a bolt, pin, rivet, fastener etc. In the preferred molded embodiment, the apparatus 10 comprises a longitudinal section 14 and a lateral section 16 that are interconnected by axis 180 as shown in cross sectional view FIG. 10. In general appearance, the two-piece molded inserts looks like an extended Roman numeral one with the top portion, item 130 being the receptacle to hold the handle 120. The handle is supported by the attachment body 14 that is a recessed cavity to hold the floor handle. Accordingly the upper sleeve portion of the cylindrical sleeve section 130 includes an axial bore 140 having a uniform dimension so as to receive therein the transverse dimension of the handle 120. The thickness of the material-encapsulating handle 120 is sufficient to not crack when impact to the head of the floor cleaning apparatus occurs. The upper sleeve section 130 has a diameter to tightly receive in a generally slip-fit relationship the transverse dimension of the handle to frictionally retain the handle therein. It is not limited to the intent of this invention as to how the handle is retained and can be either threaded or attached by a bolt or rivet. The overall configuration of the lower member 18 as it joins to the floor cleaning apparatus frame support clamp recess cavity 160 resembles an inverted "T" with the mid portion of the vertical leg being thin in the middle and the lower portion of the leg extending outboard in both the left and right lateral directions to form the clamp mechanism 16 as shown in FIG. 1 The clamp mechanism 16 when attached to the floor cleaning head support frame 170 retains the floor cleaning apparatus head. When the clamp mechanism Referring to FIG. 2. there is illustrated in a perspective view the relationship between the perspective floor cleaning brush head 163 and floor cleaning handle attachment 10. The present invention includes a two sectional connector adjoined together through axis shaft 180. The lower section 12 comprising of a clamping mechanism section and an upper section 11 comprising of the handle support hole. Both sections are a one piece unitary molded part adjoined only be way of axis 180. The floor cleaning brush head support frame 161 is encapsulated by the clamp mechanism 16 and supported by the lateral recess cavity 160. The support frame 161 has an approximate diameter between 0.25 to 0.50 of an inch. The larger diameter allows for the cleaning head to be a unitary one piece injected molded apparatus. The lower support member 18 adjoins the clamp mechanism 16. When the clamp mechanism 16 is disengaged from the support frame 170 the cleaning brush head 163 or cleaning head devices can be used as a hand held cleaning device using ergonomic hand hold 17.

Referring to FIG. 3. Illustrates the clamp mechanism 16 and the protruding push lever 171 that allows leverage to open the jaws of the clamp.

Referring to FIG. 4. Illustrates the movement of the swivel connector when in contact with a stationary object. The floor cleaning attachments lower support member 18 can rotate around the axis shaft 180 over 90 degrees in relation to the floor cleaning handle support 14.

Referring to FIG. 5. there is Illustrates the unitary elastomeric clamp mechanism. The clamp mechanism 16 has an upper jaw 152 and lower jaw 150 with an opening slotted jaw 170 that extends laterally. Opening 170 allows for access to cavity 160 that loosely supports the floor dust mop frame in order to pivot along the lateral axis. The upper clamp 152 remains rigid while the lower clamp 150 pivots around the lateral axis at 172. Protruded lever 171 when depressed displaces cavity 172 allowing for lower clamp 150 to move forward in relation to upper clamp 152 allowing for opening 170 to enlarge as shown in FIG. 6. Hinge 173 allows for a preload to occur around the clamping mechanism. The peripheral side arm type jaws 177, wrap around the axis shaft 180.

Referring to FIG. 6. There is Illustrates the elastomeric connector with phantom lines illustrating the flexing movement when pushed and pulled by exertion of a force thus preventing said handle member, swivel attachment, and/or floor cleaning apparatuses from being damaged. There is Illustrated the movement of the clamp mechanism between upper and lower clamps 150 and 152 when force is applied to protruded lever 171 on side 174.

Referring to FIG. 7. there is an isometric illustration of the attachment in its entirety.

Referring to FIG. 8. there is Illustrated a cross sectional view with the flexible elastomeric material shaped as a rectangle. The purpose of a rectangular shape is to allow for maximum flexibility in the lateral movement yet retains rigidity in the forward and aft movement.

Referring to FIG. 9. there is shown an isometric illustration of an alternate embodiment of present invention without the protruding lever to ease in opening the clamp in its entirety. Also shown is jam pin 185 inserted into support member 18 and arm type jaws 177 to jam/stop the rotation of the swivel joint around axis 180. Storage hole 187 is shown that would house the jam pin 185 when normal swivel movement of the connector is required.

This alternative embodiment is identical for attaching the base of the apparatus to a floor cleaning device support frame that is illustrated in FIG. 9. The alternate attachment is identical to the previous attachment described except has no protruding lever 171. However, there is still the open recessed cavity 170 as depicted in FIG. 5 that allows for ease of installing the attachment onto the floor cleaning apparatus frame. To install the alternate embodiment, the operator must apply force to press on the attachment onto the floor dust mop frame.

Referring to FIG. 10. there is Illustrated a cross sectional view of the attachment in its entirety, The peripheral symmetrical side arm type jaws 177, preloaded and wrapped around the unitary elastomer expandable axis shaft 180.

Referring to FIG. 11. there is illustrated a section view of the peripheral symmetrical arm type jaws 177 revealing the preload movement once inserted onto the expandable elastomer axis shaft 180. The preloaded jaws 177 around expandable elastomer shaft 180 eliminates wobble and excessive movement of the cleaning head during a cleaning operation.

Referring to FIG. 12. there is illustrated an alternate embodiment 178 that encapsulates axis shaft 180. The hole size for shaft 180 will be undersized causing a preload condition to eliminate wobble during a cleaning operation. This method would allow for a pin, fastener or bolt to attach the upper and lower members together.

Defined broadly, the present invention is a two-piece swivel type floor cleaning attachment that can easily be engaged or disengaged to small cleaning apparatuses, such as scrub brushes, allowing for hand operation of prior art floor-cleaning apparatuses.

Therefore, through use of the present invention, a flexible swivel type attachment can be easily engaged or disengaged and not be affixed onto floor cleaning apparatuses can now be manufactured that is economical, and can be also used as a hand held cleaning device since a u-joint or other type swivel attachments are no longer needed to be affixed to the cleaning head device.

Of course the present invention is not intended to be restricted to any particular form or arrangement, or any specific embodiment disclosed herein, or any specific use, since the same may be modified in various particulars or relations without departing from the spirit or scope of the claimed invention herein above shown and described of which the apparatus shown is intended only for illustration and for disclosure of an operative embodiment and not to show all of the various forms or modification in which the invention might be embodied or operated.

The invention has been described in considerable detail in order to comply with the patent laws by providing full public disclosure of at least one of its forms. However, such detailed description is not intended in any way to limit the broad features or principles of the invention, or the scope of patent monopoly to be granted.

What I claim as my invention is:

1. A floor cleaning apparatus comprising:

a cleaning head connected to a two piece unitary flexible molded elastomeric swivel joint;

a. the cleaning head has a top mounting surface and a bottom cleaning surface, the top mounting surface has a support frame extending along the longitudinal axis of the head;

b. the two piece swivel joint comprises a lower support member and an upper support member, the lower support member has a first end and a second end, the first end of the lower support member comprises a unitary flexible transverse clamping section having an upper jaw and a lower jaw, the upper and lower jaws form a slotted opening which interconnects with a retaining cavity for receiving the support frame of the cleaning head, the lower jaw has a push lever integrally formed therewith, such that when the push lever is forced inwardly, the lower jaw is moved away from the upper jaw for allowing the support frame to be inserted through the slotted opening and secured within the retaining cavity when the push lever is released;

c. and the upper support member has a first end and a second end, the first end of the upper support member has a longitudinal attachment section having an axial bore with an open end to receive a longitudinal handle, the handle has one end press fitted from the open end and secured within the axis bore of the upper support member, the second ends of the lower support member and the upper support member are connected via a pivoting member forming a universal joint, to allow for rotation around a lateral axis, the upper and lower support members are made from an elastomeric flexible material so that when the cleaning apparatus comes in contact with stationary objects or is abused, the two piece unitary swivel joint will flex and prevent damage to the handle, cleaning head and joint.

2. The floor cleaning apparatus of claim 1 further comprising a pin that can be positioned in the second end of the lower member and the second end of the upper member to lock the two piece swivel joint in place, to prevent swiveling around the lateral axis, however still allowing for some flexing due to the flexible material nature of the swivel joint when the cleaning apparatus comes in contact with stationary objects to prevent breakage.

3. The floor cleaning apparatus in accordance with claim 1 wherein said either and/or upper or lower support members are made out of a flexible plastic material with memory.

4. The floor cleaning apparatus in accordance with claim 2 wherein said pin to lock swivel joint can be stored in a storage hole when normal swivel movement of the connector is required.

5. The floor cleaning apparatus in accordance with claim 1 wherein said either and/or upper or lower support members is made out of a elastomer plastic material.

6. A floor cleaning apparatus comprising:

a cleaning head connected to a two piece unitary flexible molded elastomeric swivel joint;

a. the cleaning head has a top mounting surface and a bottom cleaning surface, the top mounting surface has a support frame extending along the longitudinal axis of the head;

b. the two piece swivel joint comprises a lower support member and an upper support member, the lower support member has a first end and a second end, the first end of the lower support member comprises a unitary flexible transverse clamping section having an upper jaw and a lower jaw, the upper and lower jaws form a slotted opening which interconnects with a retaining cavity for receiving the support frame of the cleaning head, means for forcing either one of said upper and lower jaws away from the other one of said upper and lower jaws for allowing said support frame of said cleaning head to be inserted through said opening and secured with said retaining means;

c. and the upper support member has a first end and a second end, the first end of the upper support member has a longitudinal attachment section having an axial bore with an open end to receive a longitudinal handle, the handle has one end press fitted from the open end and secured within the axis bore of the upper support member, the second ends of the lower support member and the upper support member are connected via a pivoting member forming a universal joint, to allow for rotation around a lateral axis, the upper and lower support members are made from an elastomeric flexible material so that when the cleaning apparatus comes in contact with stationary objects or is abused, the two piece unitary swivel joint will flex and prevent damage to the handle, cleaning head and joint.

7. The floor cleaning apparatus of claim 6 further comprising a pin that can be positioned in the second end of the lower member and the second end of the upper member to lock the two piece swivel joint in place, to prevent swiveling around the lateral axis, however still allowing for some flexing due to the flexible material nature of the swivel joint when the cleaning apparatus comes in contact with stationary objects to prevent breakage.

8. The floor cleaning apparatus in accordance with claim 6 wherein said either and/or upper or lower support members are made out of a flexible plastic material with memory.

9. The floor cleaning apparatus in accordance with claim 7 wherein said pin to lock swivel joint can be stored in a storage hole when normal swivel movement of the connector is required.

10. The floor cleaning apparatus in accordance with claim 6 wherein said either and/or upper or lower support members is made out of a elastomer plastic material.

11. The floor cleaning apparatus in accordance with claim 6 wherein said axial bore includes a cavity.

12. A swivel cleaning attachment in accordance with claim 1 or 6, in which said flexible attachment member clamp is made out of an elastomer material to allow preload gripping interference force.

13. A swivel cleaning attachment in accordance with claim 1 or 6, in which said flexible attachment member clamp is made out of a plastic material to allow preload gripping interference force.

14. A swivel cleaning attachment in accordance with claim 1 or 6, in which said flexible attachment member clamping sections are made out of compressible expandable elastomer material to allow preload gripping force.

* * * * *